United States Patent [19]

Funahashi

[11] 4,043,681

[45] Aug. 23, 1977

[54] WRITING INSTRUMENT

[76] Inventor: Takaji Funahashi, No. 1, 2-chome, Kitatakasho, Nishi, Nagoya, Aichi, Japan

[21] Appl. No.: 713,913

[22] Filed: Aug. 12, 1976

[30] Foreign Application Priority Data

Sept. 22, 1975 Japan ..... 50-129866[U]

[51] Int. Cl.[2] ..... B43K 5/10

[52] U.S. Cl. ..... 401/151; 401/153; 401/206; 401/278

[58] Field of Search ..... 401/151, 153, 205, 206, 401/198, 199, 223, 270, 278

[56] References Cited

U.S. PATENT DOCUMENTS

| | | | |
|---|---|---|---|
| 3,181,539 | 5/1965 | Aston | 401/198 X |
| 3,640,631 | 2/1972 | Sotir | 401/206 |
| 3,682,559 | 8/1972 | Hirota | 401/198 X |
| 3,819,284 | 6/1974 | Kreuzer | 401/151 |

*Primary Examiner*—Stephen C. Pellegrino

[57] ABSTRACT

In a writing instrument comprising a writing core and an ink tank, the contact of the writing core with the ink in the ink tank is intercepted so that unnecessary loss of the ink due to evaporation from the core surface and excessive supply of the ink to the core are effectively prevented. Merely pressing the end portion of the outer case of the writing instrument allows a spring, a valve member and a flexible bellows portion of the ink tank to supply an appropriate amount of ink into the core.

1 Claim, 6 Drawing Figures

WRITING INSTRUMENT

BACKGROUND OF THE INVENTION

The present invention relates to a writing instrument.

So called felt pens and sign pens comprising a writing core composed of an ink-absorbing material such as felt and a cylinder containing therein an ink absorber having an ink absorbed therein and being composed of a porous material or an ink tank containing an ink therein have heretofore been marketed and used as writing instruments.

In writing instruments of this type, since the core always contacts an ink absorbed or contained in the ink absorber or ink tank, even if the writing instrument is not used, the ink in the ink absorber or ink tank is perpetually absorbed in the core and the ink absorbed in the core is lost by evaporation from the surface of the core. Further, the ink in the ink absorber or ink tank is expanded when the temperature rises and it leaks excessively from the surface of the core. These are defects of the conventional writing instruments of this type.

SUMMARY OF THE INVENTION

It is a primary object of the present invention to provide a writing instrument in which the foregoing defects involved in the conventional writing instruments can be overcome.

Another object of the present invention is to provide a writing instrument in which the contact between a core and an ink in an ink tank is ordinarily intercepted and in which the core is allowed to fall in contact with the ink in the ink tank optionally according to need.

In accordance with the present invention, there is provided a writing instrument comprising an ink tank having a flexible bellows portion and having an opening at one end and a bottom at the other end, a neck member including a first cylinder closely fitted on the outside of said one end of the ink tank and a second cylinder connected to said first cylinder and having an inner diameter smaller than that of the first cylinder, a lid member having a peripheral edge portion disposed in the first cylinder of said neck member and having a valve seat hole at the center thereof, a cap member including a flange disposed in the first cylinder of said neck member, a third cylinder connected to said flange and fitted closely in the second cylinder of said neck member and a fine liquid discharge tube connected to said third cylinder and having an inner diameter smaller than that of said third cylinder, a valve member including a valve to be seated in the valve seat hole of said lid member, a first rod portion connected to one end of said valve and loosely inserted in said third cylinder of said cap member and a second rod portion connected to the other end of said valve and having a free end contacted with the inner face of the bottom of said ink tank, a compression spring interposed between the free end face of said third cylinder of said cap member and said one end of said valve to seat said valve in said valve seat hole, and a tubular writing core composed of an ink-absorbing material and having one end fitted and inserted between said second cylinder of said neck member and the fine liquid discharge tube and having the other end closed, wherein the peripheral edge portion of said lid member and the flange of said cap member are supported and held by the open end portion of said ink tank and the first cylinder of said neck member, whereby a first chamber is formed among said lid member, the free end face of the third cylinder and the first rod portion of said valve member and a second chamber is formed between the free end of the first rod portion of said valve member and the third cylinder of said cap member.

DESCRIPTION OF THE PREFERRED EMBODIMENTS

The present invention will now be described in detail by reference to the accompanying drawing.

Figure 1:
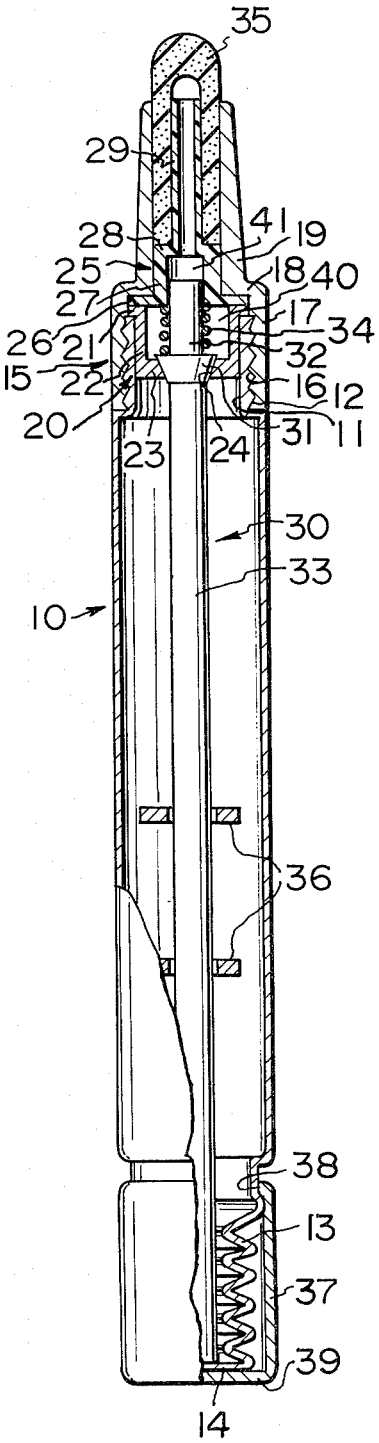
FIG. 1 is a partial longitudinally sectional view of a first embodiment of the writing instrument according to the present invention.

Referring to FIG. 1 showing the first embodiment of the present invention, an ink tank 10 has a shape of a long cylinder and it has an opening 11 at one end. A male screw 12 is disposed on the periphery of the open end portion of the ink tank 10 and the ink tank 10 has a flexible bellows portion 13 on the other end and a bottom 14 on the end face thereof.

A neck member 15 comprises a first cylinder 17 having a female screw 16 to be engaged with the male screw 12 disposed at the open end portion of the ink tank 10. a first shoulder portion 18 connected to the first cylinder 17 and a second cylinder 19 connected to the first shoulder portion 18 and having an inner diameter smaller than that of the first cylinder 17.

A lid member 20 comprises a peripheral edge portion 21 disposed in the first cylinder 17 of the neck member, an intermediate cylinder 22 connected to the peripheral edge portion and a plate-like portion 23 connected to the intermediate cylinder 22. The plate-like portion 23 has a valve seat hole 24 at the center thereof.

A cap member 25 comprises a flange 26 disposed in the first cylinder 17 of the neck member 15, a third cylinder 27 connected to the flange 26 and fitted closely in the second cylinder 19 of the neck member 15, a second shoulder portion 28 connected to the third cylinder 27 and a fine liquid discharge tube 29 which is connected to the second shoulder portion 28 and has an inner diameter smaller than that of the third cylinder 27.

A valve member 30 comprises a valve 31 to be seated in the valve seat hole 24 of the lid member 20, a first rod portion 32 connected to one end of the valve 31 and inserted loosely with a small clearance into the third cylinder 27 of the cap member 25 and a second rod portion 33 connected to the other end of the valve 31 and having a free end contacted with the inner face of the bottom 14 of the tank ink 10 substantially at the center thereof.

A compression spring 34 is interposed between the free end face of the third cylinder 27 of the cap member 25 and said one end of the valve 31 to seat the valve 31 in the valve seat hole 24.

A writing core 35 has a tubular form having one end opened and the other end closed. The core 35 is composed of an ink-absorbing material such as felt, and the open end is fitted and inserted between the second cylinder 19 of the neck member 15 and the fine liquid discharge tube 29.

The peripheral edge portion 21 of the lid member 20 and the flange 26 of the cap member 25 are supported and held by the end of the opening 11 of the ink tank 10 and the first shoulder portion 18 of the neck member 15.

The cap member 25 is preferably made of a synthetic resin such as a polyethylene resin, a polypropylene resin, or the like.

In the ink tank 10, an ink-agitating ring 36 is loosely inserted in the second rod portion 33.

A case 37 comprises a short cylinder having an opening 38 on one end and the other end 39 closed. The open end portion 38 is loosely inserted into the ink tank 10, and the bellows portion 13 is covered with the case 37. The case 37 is disposed so that it can slide with respect to the ink tank 10. Accordingly, when the closed end 39 of the case 37 is pressed, the bellows portion 13 is contracted.

The cap member 25 may be made of polyethylene resin, a polypropylene resin or other synthetic resin.

A first chamber 40 is formed among the lid member 20, the free end face of the third cylinder 27 of the cap member 25 and the first rod portion 32 of the valve member 30.

A second chamber 41 is formed between the free end face of the first rod portion 32 of the valve member 30 and the third cylinder 27 of the cap member 25.

In the writing instrument having the above structure, the opening 11 of the ink-filled ink tank 10 is ordinarily sealed by the lid member 20 and the valve seat hole 24 of the lid member 20 is ordinarily sealed by the valve 31 pressed by the spring 34. Accordingly, in the ordinary state, the ink in the ink tank 10 is prevented from leaking through the valve seat hole 24 and excessive supply of the ink to the core 35 is inhibited.

When the amount of the ink absorbed in the writing core 35 is reduced by use of the writing instrument, if the end 39 of the case 37 is pressed, the bellows portion 13 is contracted to press the valve member 30, and the valve 31 is moved against the spring 34 to open the valve seat hole 24. Simultaneously, the inlet of the fine liquid discharge tube 29 is closed by the free end of the first rod portion 32 and the ink tank 10 is communicated with the first chamber 40, whereby the ink in the ink tank 10 is supplied into the first chamber 40.

When compression of the case 37 is released to restore the spring 34 and the bellows portion 13 to the original positions, the ink in the first chamber 40 is supplied into the second chamber 41 through the clearance between the first rod portion 32 and the third cylinder 27, and the ink is then supplied to the core 35 through the liquid discharge fine tube 29 and absorbed in the core 35.

According to the present invention, in the ordinary state the contact of the core with the ink in the ink tank is intercepted and therefore, unnecessary loss of the ink is prevented and no leakage of ink results even when the temperature rises. Further, the ink can be supplied to the core optionally according to need.

Figure 2:
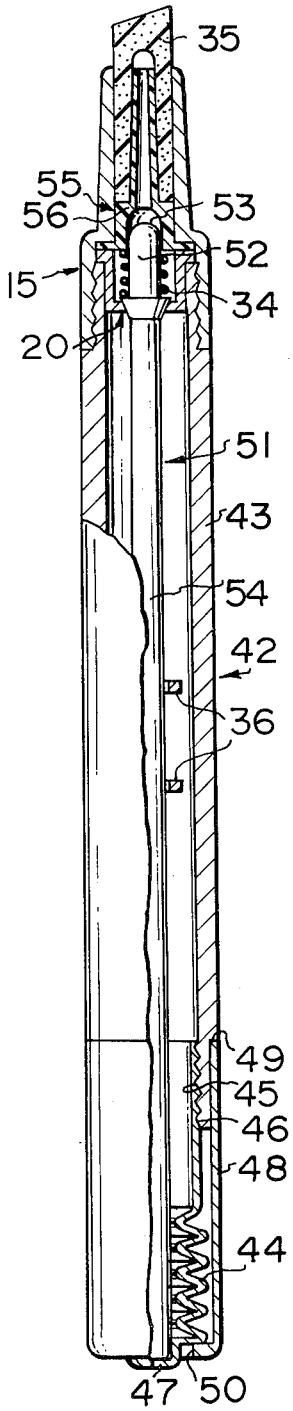
FIG. 2 is a partial longitudinally sectional view of a second embodiment of the writing instrument according to the present invention.

The second embodiment shown in FIG. 2 has a structure similar to that of the first embodiment shown in FIG. 1 except for the following points.

An ink tank 42 comprises a long cylinder 43 and a bellows portion 44, and a male screw 46 disposed at an opening on one end of the bellows portion 44 is engaged with a female screw 45 disposed at an opening on one end of the long cylinder 43. The bellows portion 44 has a projection 47 on the bottom thereof.

A case 48 is attached to the long cylinder 43 at an open end 49 thereof and has a central opening 50 at the bottom thereof. The projection 47 of the bellows portion 44 extends over this central opening 50 of the case 48.

A free end 53 of a first rod portion 52 of a valve member 51 has a semi-spherical shape and a free end of a second rod portion 54 fitted to have contact with the inner face of the projection 47 of the bellows portion 44.

A shoulder portion 56 of a cap member 55 has a semi-spherical shape corresponding to the semispherical shape of the end 53 of the first rod portion 52.

In the writing instrument having the above structure, when the projection 47 is pressed, the bellows portion 44 is contracted and the semi-spherical end 53 of the first rod portion 52 of the valve member 51 comes into the close contact with the semi-spherical shoulder portion 56 of the cap member 55, whereby the inlet of the fine liquid discharge tube is assuredly closed.

Figure 3:
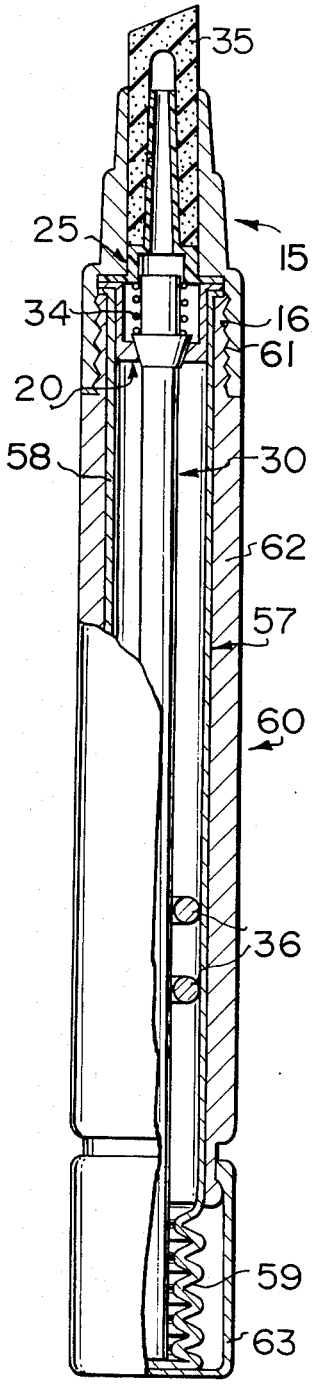
FIG. 3 is a partial longitudinally sectional view of a third embodiment of the writing instrument according to the present invention.

The third embodiment shown in FIG. 3 has a structure similar to that of the first embodiment shown in FIG. 1 except for the following difference.

An ink tank 57 has a long cylinder 58 and a bellows portion 59 connected to one end of the long cylinder 58.

A case 60 comprises a long cylinder 62 having a male screw 61 on one end and fitted on the outer periphery of the long cylinder 58 along the entire length thereof and a short cylinder 63 slidably fitted and inserted in the other end of the long cylinder 62. The short cylinder 63 is disposed to cover the outside of the bellows portion 59.

The female screw 16 of the neck member 15 is screwed with the male screw 61 of the case 60.

Figure 4:
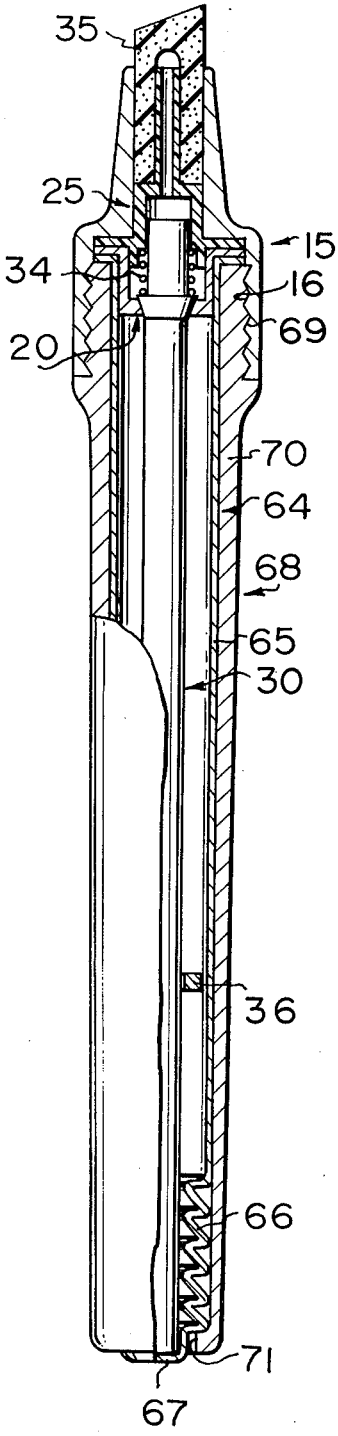
FIG. 4 is a partial longitudinally sectional view of a fourth embodiment of the writing instrument according to the present invention.

The fourth embodiment shown in FIG. 4 has a structure similar to that of the first embodiment shown in FIG. 1 except for the following points.

An ink tank 64 comprises a long cylinder 65 and a bellows portion 66 connected to one end of the long cylinder 65. A projection 67 is disposed on the bottom of the bellows portion 66.

A case 68 comprises a long cylinder 70 having a male screw 69 at one end and a central opening 71 at the bottom of the other end and being fitted in an ink tank 64 along the entire length of the outer periphery thereof. The projection 67 extends over the central opening 71.

The female screw 16 is threadedly engaged with the male screw 69 of the case 68.

Figure 5:
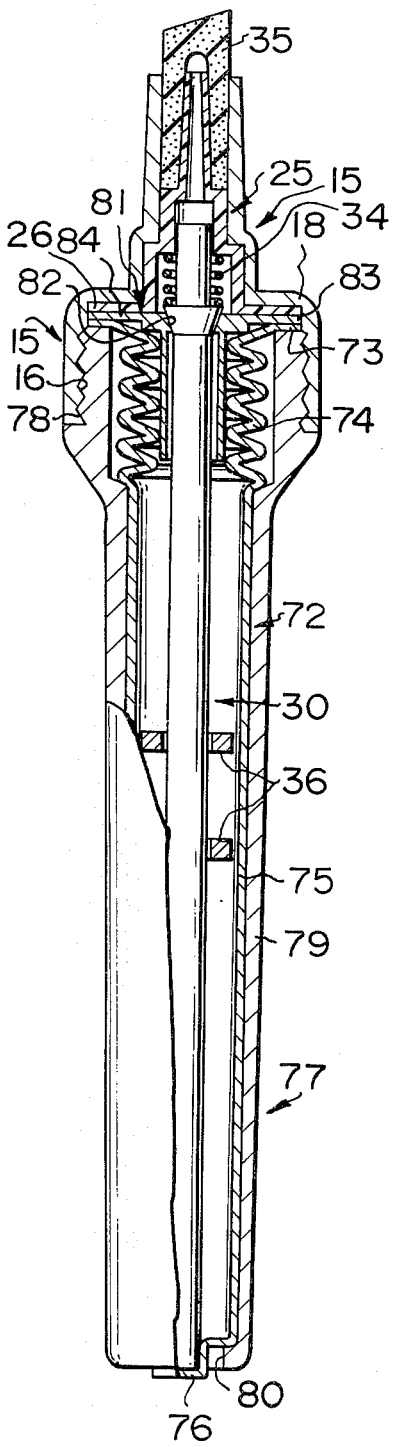
FIG. 5 is a partial longitudinally sectional view of a fifth embodiment of the writing instrument according to the present invention.

The fifth embodiment shown in FIG. 5 has a structure similar to that of the first embodiment shown in FIG. 1 except for the following points.

An ink tank 72 comprises a bellows portion 74 having a flange 73 on one end and a long cylinder 75 connected to the other end of the bellows portion 74. A projection 76 is formed on the bottom of the free end of the long cylinder 75.

A case 77 comprises a long cylinder 79 having a male screw 78 on one end and a central opening 80 on the bottom of the other end and being fitted in the ink tank 72 along the entire length of the outer periphery thereof. The projection 76 extends over the central opening 80.

The female screw 16 of the neck member 15 is threadedly engaged with the male screw 78 of the case 77.

A lid member 81 is composed of a plate 84 having a valve seat hole 82 at the center and an edge portion 83 on the outer periphery.

The flange 73 of the ink tank 72 is supported and held by the neck member 15 and said one end of the case 77 together with the edge portion 83 of the lid member 81 and the flange 26 of the cap member 25.

Figure 6:
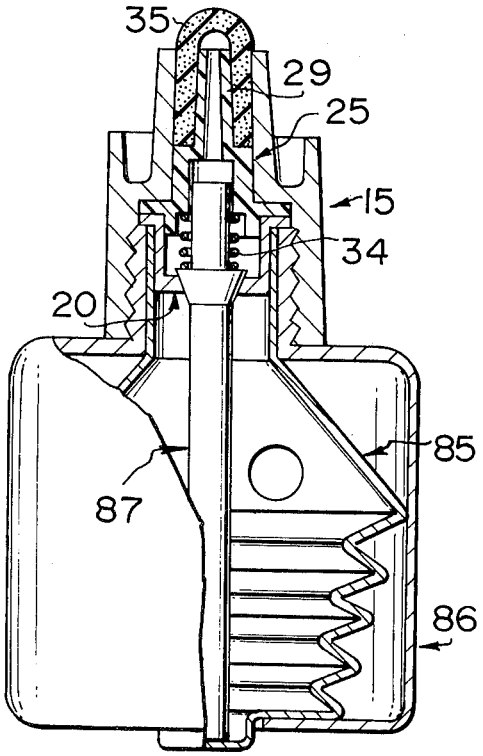
FIG. 6 is a partial longitudinal sectional view of a sixth embodiment of the writing instrument according to the present invention.

The sixth embodiment shown in FIG. 6 has a structure similar to that of the fourth embodiment shown in FIG. 4 except that the ink tank 85, case 86 and valve member 87 are relatively short in this sixth embodiment.

In the present invention, the top end of the fine liquid discharge tube 29 is preferably closed, and when the writing instrument is used, the core 35 is taken out and the top end of the fine liquid discharge tube 29 is cut off, and the core 35 is inserted again.

What is claimed is:

1. A writing instrument comprising (a) an ink tank having a flexible bellows portion and having an opening at one end and a bottom at the other end, (b) a neck member including a first cylinder closely fitted on the outside of said one end of the ink tank and a second cylinder connected to said first cylinder and having an inner diameter smaller than that of the first cylinder, (c) a lid member having a peripheral edge portion disposed in the first cylinder of said neck member and having a valve seat hole at the center thereof, (d) a cap member including a flange disposed in the first cylinder of said neck member, a third cylinder connected to said flange and fitted closely in the second cylinder of said neck member and a fine liquid discharge tube connected to said third cylinder and having an inner diameter smaller than that of said third cylinder, (e) a valve member including a valve to be seated in the valve seat hole of said lid member, a first rod portion connected to one end of said valve and loosely inserted in said third cylinder of said cap member and a second rod portion connected to the other end of said valve and having a free end contacted with the inner face of the bottom of said ink tank, (f) a compression spring interposed between the free end face of said third cylinder of said cap member and said one end of said valve to seat said valve in said valve seat hole, and (g) a tubular writing core composed of an ink-absorbing material and having one end fitted and inserted between said second cylinder of said neck member and the fine liquid discharge tube and having the other end closed, wherein the peripheral edge portion of said lid member and the flange of said cap member are supported and held by the open end portion of said ink tank and the first cylinder of said neck member, whereby a first chamber is formed among said lid member, the free end face of the third cylinder and the first rod portion of said valve member and a second chamber is formed between the free end face of the first rod portion of said valve member and the third cylinder of said cap member.

* * * * *